United States Patent [19]

Hoffman et al.

[11] 3,990,752

[45] Nov. 9, 1976

[54] DISPENSING SYSTEM AND METHOD FOR DISPENSING PACKETS

[75] Inventors: Louis S. Hoffman, Morristown, N.J.; Maurice Y. La Barre, Andover, Mass.

[73] Assignee: Diamond Crystal Salt Company, St. Clair, Mich.

[22] Filed: Jan. 7, 1975

[21] Appl. No.: 539,057

[52] U.S. Cl. ..... 312/118; 312/117; 312/291; 206/44 R; 206/459

[51] Int. Cl.[2] ..... B65D 5/50; A47F 3/14

[58] Field of Search ..... 312/118, 117, 291, 257 A; 206/459, 44 R, 44.12, 503; 211/45, 126

[56] References Cited

UNITED STATES PATENTS

| | | | |
|---|---|---|---|
| 475,197 | 5/1892 | Carr | 312/291 |
| 1,382,837 | 6/1921 | Jurek | 312/291 |
| 1,847,986 | 3/1932 | Schuette | 312/291 |
| 1,974,466 | 9/1934 | Marshburn | 206/459 |
| 2,168,240 | 8/1939 | Roberts | 206/44 R |
| 2,441,345 | 5/1948 | Brubaker | 312/291 |
| 3,290,107 | 12/1966 | Kolster | 312/117 |
| 3,306,437 | 2/1967 | Nelson | 206/459 |
| 3,335,937 | 8/1967 | Kramer | 206/459 |
| 3,351,209 | 11/1967 | Kofoed et al. | 206/459 |
| 3,500,649 | 3/1970 | Feldman | 312/291 |

FOREIGN PATENTS OR APPLICATIONS

| | | | |
|---|---|---|---|
| 404,116 | 1/1934 | United Kingdom | 206/44.12 |
| 856,615 | 12/1960 | United Kingdom | 211/126 |

*Primary Examiner*—Paul R. Gilliam
*Assistant Examiner*—Victor N. Sakran
*Attorney, Agent, or Firm*—Harness, Dickey & Pierce

[57] ABSTRACT

A dispensing system for dispensing a selected combination of disposable portion control packets and the like including a carton containing a plurality of stackable inner cartons, each of which is filled with a plurality of a selected type of disposable packets and wherein the outer carbon is formed with removable sections in the face panel thereof, which in turn are positioned in registration with removable sections provided in the front end portions of each of the inner cartons so as to provide access to and enable the dispensing of a disposable packet from each inner carton. The present invention further contemplates the method of dispensing a combination of packets in accordance with the foregoing arrangement, and further including a coding system, such as a color coding, to visually indicate the nature of the combination of packets dispensed, as well as the completeness and correctness of the combination.

3 Claims, 13 Drawing Figures

Fig. 5.
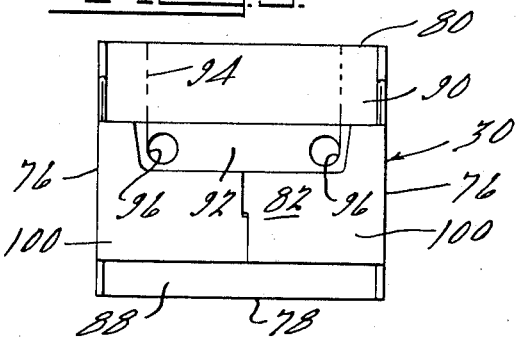
Fig. 6.
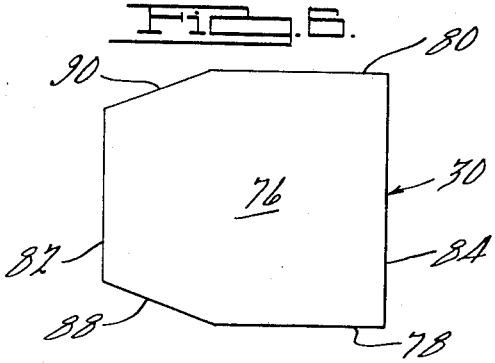
Fig. 7.
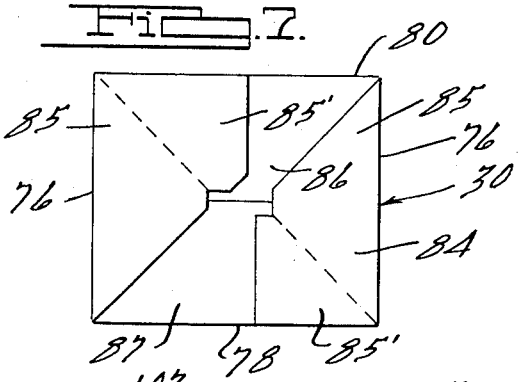
Fig. 8.
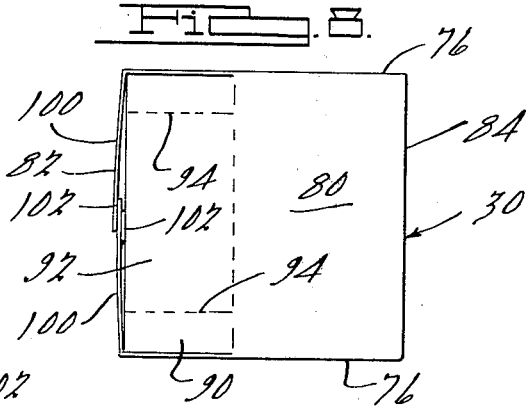
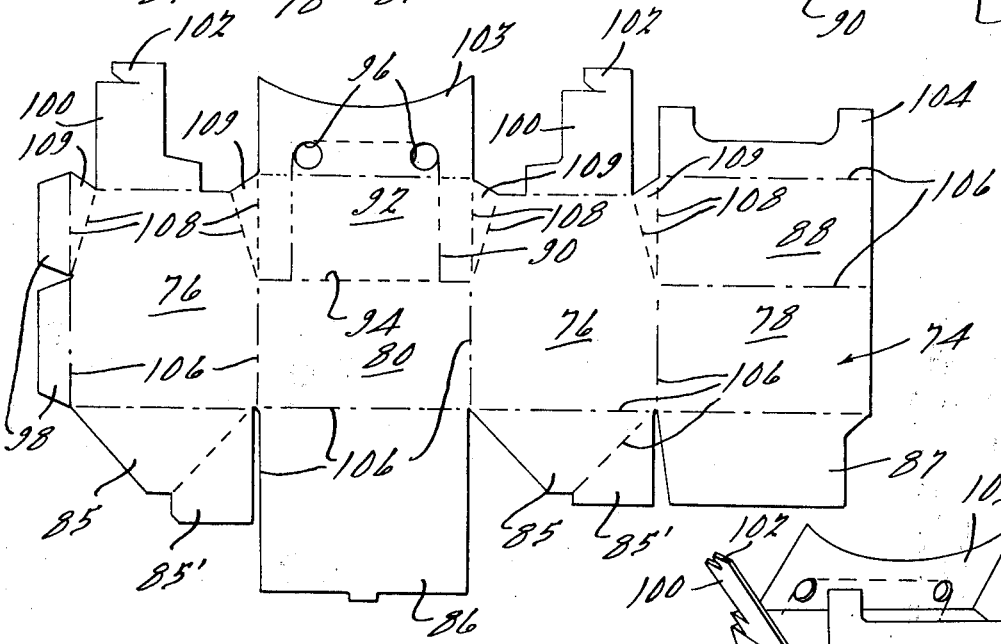
Fig. 9.
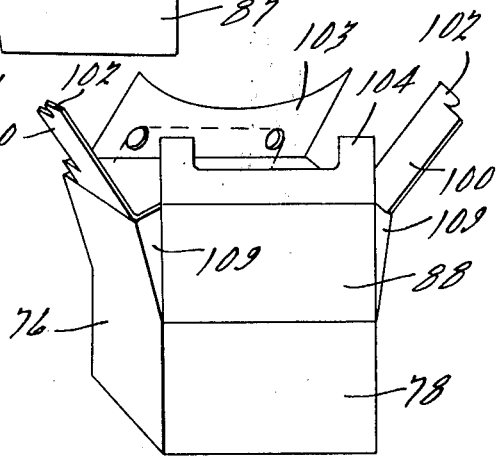
Fig. 11.

DISPENSING SYSTEM AND METHOD FOR DISPENSING PACKETS

BACKGROUND OF THE INVENTION

The present invention is particularly applicable but not necessarily restricted to dispensing systems for dispensing selected combinations of disposable portion control items possessed of special characteristics on the trays of a food service line and particularly, in food service lines of hospitals and institutions. It is important in the feeding of patients of hospitals and institutions who are under special diet restrictions, that they receive only those condiments which are consistent with and permitted by the dietary program prescribed. For example, certain dietary programs of patients in hospitals and other institutions may provide a salt-free or a sugar-free diet in lieu of regular diets, and in which event salt substitutes and sugar substitutes, respectively, are placed on the food tray. The specific combination of condiments will also vary from meal to meal with respect to the number of packets required, such as a double sugar for breakfasts, as well as perhaps additional utensils, such as napkins, drinking tubes or straws, moist cleansing towelette packets, etc., for the patient's convenience.

Dispensing systems of the foregoing type have heretofore been used or proposed for use and include color-coded packet dispenser systems of the type shown and described in U.S. Pat. Nos. 3,306,437 and 3,351,209, which are owned by the assignee of the present invention. The systems described in the aforementioned United States patents include sleeves or cartons containing a plurality of individual envelopes comprising meal service kits, each containing a plurality of individual items including packets of condiments, as well as eating utensils including plastic knives, forks, spoons, napkins, drinking tubes, etc. Each meal service kit is encapsulated within a sanitary envelope, which preferably is comprised of cellophane to enable visual inspection of its contents.

While dispensing systems of the type disclosed in the two aforementioned United States patent have found widespread acceptance in hospital and institutional use, individual preferences of food handling personnel has at times resulted in the use of bulk-type dispensing arrangements which simply comprise individual large cartons filled with a large number of packets, each of the same characteristics. In the normal use of bulk dispensing systems, the prescribed type and number of packets are placed on a food tray by the food handling personnel and is ultimately checked by the dietician to make certain that the condiments for the correct diet have been dispensed. Unfortunately, all too often, such bulk dispensing systems result in one or more items of the selected combination of packets to be omitted or others to be inadvertently included, which serves not only as a source of irritation to the patient, but is potentially harmful due to variances from the prescribed diet for such patient.

Attempts to combine the low cost and simplicity of bulk dispensing systems with the accuracy and positive dispensing of color-coded meal service kits in accordance with the arrangement illustrated in the two aforementioned United States patents have not been successful in the past. The present invention relates to a compartmentalized coded dispenser system which provides the cost benefits and simplicity of bulk dispensing systems, while at the same time providing an arrangement which assures the accurate dispensing on a patient's tray of a combination of such packets in accordance with a prescribed diet.

SUMMARY OF THE INVENTION

The benefits and advantages of the present invention are achieved by a compartmentalized dispensing system comprising an outer carton within which a plurality of inner cartons are fittingly stacked one upon another and in side-by-side relationship, each of which in turn is filled with a selected variety of items of identical characteristics, such as disposable portion control packets containing condiments including sugar, salt and pepper, or sugar and salt substitutes. The forward end portion of each of the inner cartons is of a truncated configuration to provide a base having an upwardly sloped section for facilitating the extraction of a packet therefrom and an upper panel having a downwardly sloped section to provide adequate clearance for one's hand during the dispensing operation. Each of the inner cartons is formed with a removable section in the upper forward portion thereof, and the face panel of the outer carton against which the forward portions of the inner cartons are positioned is provided with a plurality of tear-out sections which are registrable with the removable sections of the inner cartons, thereby providing access to each of the items in the inner cartons to be dispensed.

The inner cartons are of one of a series of standardized configurations and can readily be filled with bulk quantities of the dispensable items employing mass packaging techniques. The filled inner cartons are readily loaded within the outer cartons in selected arrangements so as to provide a prescribed combination of individual selected items by removing one item from each of the inner cartons contained within an outer carton. In those situations in which the selected combination of items is less in number than the number of inner cartons that can be accommodated within the outer carton, one or more inner cartons are replaced by a "dummy" or empty carton to maintain proper support and relative positioning of the inner cartons within the outer carton as required during shipment and storage, as well as during the ultimate dispensing operation.

In accordance with a preferred embodiment of the present invention, the face panel of the outer carton adjacent to the tear-out sections is provided with imprinted indicia preferably in a distinctive color code which correlates with corresponding indicia imprinted on the individual items, such as disposable packets, within the inner cartons, whereby the resultant dispensed combination can readily be visually checked for correspondence in type as well as quantity.

In its method aspects, the present invention contemplates el

In its method aspects, the present invention contemplates a process for dispensing individual items in a manner to provide groups or combinations thereof of selected number and type by providing a plurality of bulk quantities of each of the individual items and placing the selected grouping of bulk quantities within an outer carton from which they can be individually removed through access apertures provided in the walls and panels of the outer carton and the inner cartons. The process further contemplates the provision of a coding system such as imprinted indicia and/or distinctive color coding of the individual dispensable items and the face panel of the outer carton to visually indicate a correlation between the assemblage of dispensed items in accordance with a prescribed dietary or other combination.

Additional advantages and benefits of the present invention will become apparent upon a reading of the description of the preferred embodiments taken in conjunction with the accompanying drawings.

BRIEF DESCRIPTION OF THE DRAWINGS

FIG. 5 is a front elevational view of an inner carton shown in FIG. 4;

FIG. 6 is a side elevational view of the inner carton shown in FIG. 5;

FIG. 7 is a rear elevational view of the inner carton shown in FIG. 5;

FIG. 8 is a plan view of the inner carton shown in FIG. 5;

FIG. 9 is a plan view of a die-cut sheet assemblable into an inner carton such as shown in FIG. 5;

FIG. 11 is a perspective view of an inner carton which has been assembled to a filling stage in which condition it can quickly and automatically be filled with a bulk quantity of dispensable items of identical characteristics;

DESCRIPTION OF THE PREFERRED EMBODIMENTS

Figure 2:
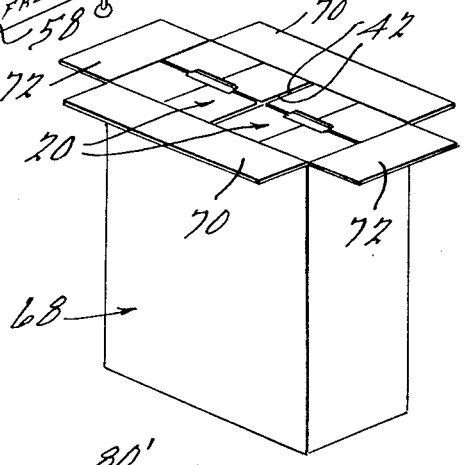
FIG. 2 is a perspective view of a shipping carton containing two outer cartons, each filled with a plurality of inner cartons containing a selected combination of items to be dispensed.
Figure 3:
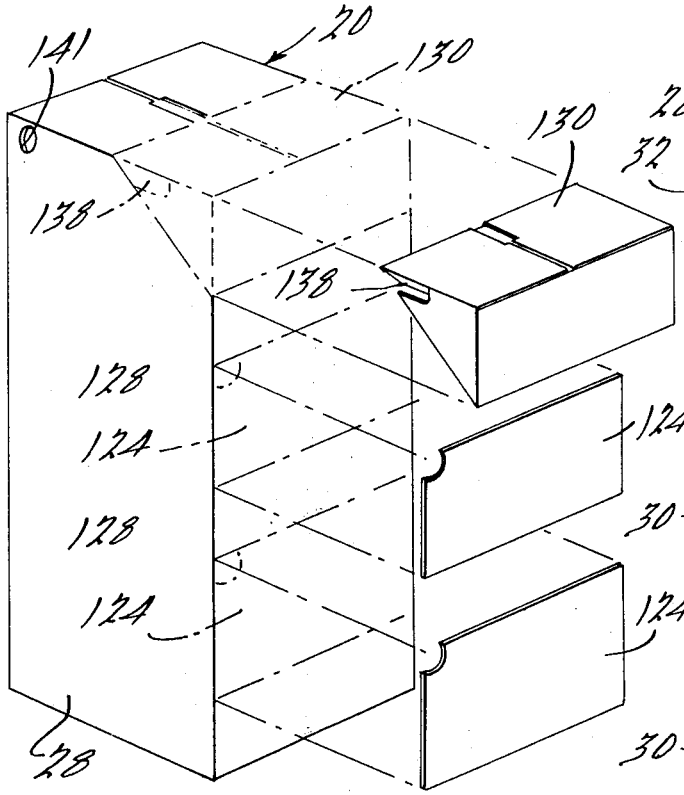
FIG. 3 is a perspective view of a typical outer carton, such as shown in FIG. 1, illustrating the position of tear-out sections on the face panel thereof for gaining access to the interior of the inner cartons therein.
Figure 4:
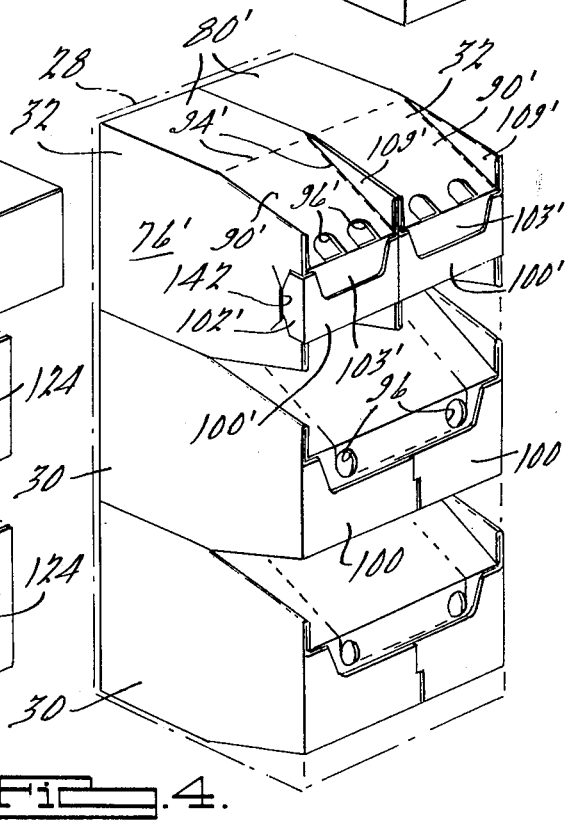
FIG. 4 is a perspective view of a plurality of stacked inner cartons disposed within an outer carton indicated in phantom which is of the same type as that shown in FIG. 3.

Referring now in detail to the drawings, and as may be best seen in FIGS. 1–4, a dispenser system constructed in accordance with the present invention comprises a plurality of individual dispensing units, such as units 20, 22, 24, which can conveniently be placed on a counter adjacent to a meal service line in side-by-side relationship or, alternatively, can be supported within a wire supporting stand 26 constructed so as to accommodate a desired number of individual dispensng units to provide the required variation in the combination of items to be dispensed. Each individual dispensing unit comprises an outer carton 28 within which a plurality of inner cartons, as best seen in FIG. 4, including inner cartons 30 and inner cartons 32, are disposed in stacked relationship, and which in turn are adapted to be filled with a bulk quantity of dispensable items of the same characteristics.

As will be noted in FIG. 4, the inner cartons 32 are of a width substantially one-half the width of the inner cartons 30 but are of the same elevational size and configuration, and in their structural aspects, are substantially identical to the inner cartons 30. The use of smaller inner cartons 32 is enabled by the smaller size or volume of certain dispensible items, enabling the packaging of a prescribed bulk quantity, such as 500 for example, in a volume of only one-half that required for packaging a like bulk quantity of other dispensable items of a larger individual size or volume. It will be understood that in addition to the inner cartons 30, 32 as shown in FIG. 4, alternative inner cartons (not shown) can be provided which are of a standardized width comprising a fraction of the width of the outer carton so as to enable adjustments in volume to accommodate a variety of different-sized dispensable items, while at the same time assuring a substantially complete filling of the interior of the outer carton, whereby the inner cartons provide mutual support for each other.

Figure 1:
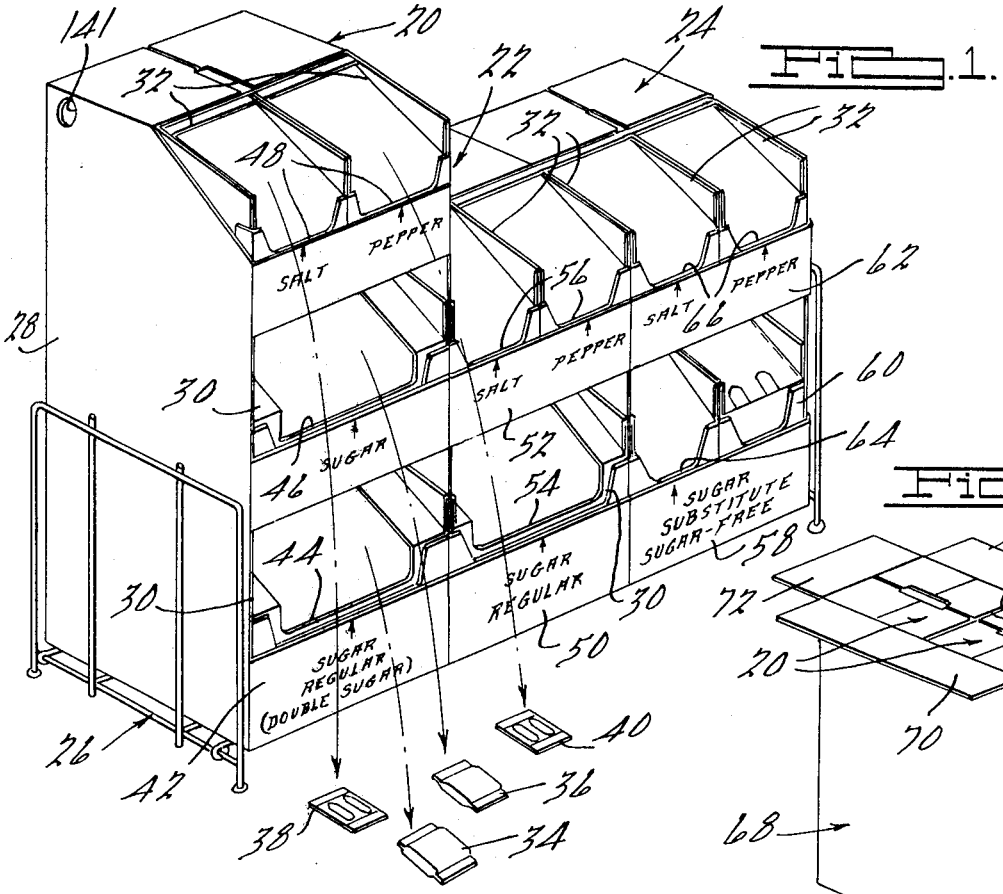
FIG. 1 is a perspective view of a typical arrangement of a dispensing system in accordance with the present invention comprising three outer cartons disposed in side-by-side relationship and supported by a rack adapted to be placed adjacent to a food service line.

In consideration of the foregoing, a typical dispensing arrangement is illustrated in FIG. 1 in which the dispensing unit 20 is provided with an inner carton arrangement in accordance with that shown in FIG. 4, and wherein the lowermost inner carton 30 is filled with disposable sugar pouches 34, the inner carton 30 directly above similarly is filled with sugar pouches 36 of the same number, while the two uppermost inner cartons 32 are filled with a like number of salt packets 38 and pepper packets 40, respectively. The foregoing dispensed packet combination, namely, two sugar pouches, a salt and a pepper packet, is designated "Regular-Double Sugar" and is conveniently color-coded "blue". Such printed indicia are conveniently applied to the face wall 42 and clearly indicate the contents of the dispensing unit and the specific location of each type of packet adjacent to the dispensing apertures 44, 46, 48 therethrough. The foregoing combination is typical of that for a patient under no dietary restrictions which provides an extra sugar pouch, such as may be required during a breakfast serving containing both coffee and cereal.

The dispensing unit 22 of FIG. 1 is representative of a "Regular" combination, providing a sugar pouch, a salt and a pepper packet consistent with a normal combination of condiments for a patient not under any dietary restrictions and for use in the serving of normal lunches and dinners. The Regular (single sugar) is conveniently color-coded "green" and the imprinted indicia on the face wall 50 of the outer carton 52 of the dispensing unit 22 visually indicates the disposition of the various items with respect to the dispensing apertures 54 and 56 in the face panel thereof.

The third dispensing unit 24 is representative of a combination of condiments for a patient on a sugar-free diet, whereby the lower half of its outer carton 58 is occupied by two split-type inner cartons 32, one filled with a bulk quantity of a suitable sugar substitute and with the adjacent one being unfilled, serving as a blank. The dummy unit, indicated at 60 in FIG. 1, is positioned at the lower right-hand side of the outer carton 58 and may simply comprise an unfilled split-type inner carton 32 or, alternatively, a carton of alternative simplified construction having the same exterior shape and dimensions. A face panel 62 on the outer carton 58 may bear appropriate printed indicia adjacent to the dispensing apertures 64, 66 therethrough, visually locating and identifying the types of disposable items contained within the inner cartons and the foregoing may conveniently be color-coded "yellow". The use of a lower pair of split inner cartons 32 is permitted by the reduced bulk density of sugar substitute packets in comparison to a like number of servings of conventional sugar pouches. It is also contemplated that the dummy inner carton 60, in certain instances, can be replaced by a filled inner carton containing items amenable to the service of foods, such as packets containing moist cleansing towelettes and other meal service utensils, as well as additional condiments and flavoring materials as may be desired.

Also typical of dispensing units of the general type typified by unit 22 is a bland-type diet devoid of any pepper, such that the upper right-hand inner carton, as viewed in FIG. 1, is replaced by a dummy carton similar to the dummy carton 60 of dispensing unit 24. Such bland-type diets are conventionally colorcoded "pink" and the face panel of the outer carton is appropriately imprinted with indicia to that effect. Similarly, a low-sodium or salt-free diet comprises a dispensing unit similar to unit 22, but wherein the split-type inner carton containing salt packets contains packets of salt substitute instead and the face panel of the outer carton is appropriately imprinted with indicia color-coded "gray" to visually indicate the contents thereof. The bland-type and low-sodium type diets also can be arranged in dispenser units similar to unit 20 to provide for a double serving of sugar for use during breakfast and such other meals requiring additional sugar.

It will be appreciated from the foregoing that each dispenser unit contains a selected number of inner cartons, each of which in turn contains a bulk quantity of dispensable items of the same identical characteristics and in a number equal to those items contained in the other inner cartons within that unit. Accordingly, a removal of one item from each of the inner cartons during the dispensing function provides a selected combination of items of prescribed characteristics. The standardization of a series of outer cartons, such as the outer cartons 28, which are of greater height than the outer cartons 52, 58, in further combination with standardized inner cartons, which are of the same height and may come in fractional widths of the outer carton, provides for manufacture, assembly and filling of the units employing high-speed automated techniques and provides for an almost unlimited combination of dispensable groups by a controlled selection of individual inner cartons to be placed within an outer carton. In addition to condiments of the types described in connection with FIG. 1, it is also contemplated that the inner cartons can be filled with various pouches and/or packets containing servings of a variety of flavoring materials including relishes, mayonnaise, ketchup, mustard, salad dressing, etc., for use in various commercial food catering establishments and quick order take-out restaurants.

Since the shipping carton, the outer cartons and the inner cartons are of a standardized construction, a detailed explanation of only one of each species is believed necessary for a complete understanding of the dispensing system. As shown in FIG. 2, a shipping carton 68 of a corrugated or fluted cardboard structure is shown which is filled with two dispensing units 20 positioned with their face panels 42 in face-to-face relationship. The shipping carton 68 may be of the conventional types having a closeable bottom (not shown) and a closeable top comprised of two side flaps 70 and a pair of end flaps 72, which upon folding inwardly close and protect the contents during shipment, handling and storage prior to use.

The inner cartons, such as the inner carton 30 as best seen in FIGS. 5–11, are comprised of a paperboard or other inexpensive packaging material which can be conveniently die-cut into a sheet 74 which, when folded, forms an interlocked three-dimensional enclosure. The inner carton 30 comprises a pair of side panels 76, a bottom panel 78, a top panel 80, a front or face panel 82 and a back panel 84, which preferably is of the so-called crash-bottom type facilitating an assembly of the carton from prepasted flat semi-assemblages thereof. The crash-type back panel 84 is comprised of a pair of flaps 85, a flap 87 and a flap 86 (FIGS. 9–11), which hingedly swing into position overlying the inner surface of the back panel 84, serving not only to seal the back of the carton during a loading operation, but also to impart further structural rigidity and strength thereto. The inner surfaces of the hinged sections 85′ of the flaps 85 are adhesively secured to the underlying flaps 86 and 87, respectively, to provide a flat-folded preassemblage.

The forward portion of the bottom panel 78 adjacent to the face panel 82 is formed with a downwardly sloping section 88, while the top panel 80 is formed with a similar upwardly sloping section 90, forming a somewhat truncated or tapered configuration. The sloped upper and bottom sections provide increased access to the interior of the inner cartons by providing clearance space, as best seen in FIG. 4, and also facilitating the extraction of a dispensable item from the inner carton by manual movement of the item forwardly and upwardly of the downwardly sloping section toward the dispensing aperture. The bin-shaped structure of the inner carton is particularly advantageous in facilitating removal of the dispensable items when only a relatively small quantity remain in the carton.

As best seen in FIGS. 5, 8 and 9, the inner carton in the region of the face panel and upwardly sloping section is provided with a removable section 92 demarcated by a score line or perforated line 94, which serves to structurally weaken the paperboard sheet stock so as to enable its removal by simply placing one's finger or fingers into apertures 96 to facilitate a gripping of the section. In the specific embodiment of the inner carton 30 shown in the drawings, the removable section 92 extends downwardly over the upper half of the face panel and for the major length of the upwardly-inclined panel. The location of the removable section prevents inadvertent spillage of the dispensable items contained within the inner carton, while at the same time providing unrestricted access to the interior thereof.

Figure 10:
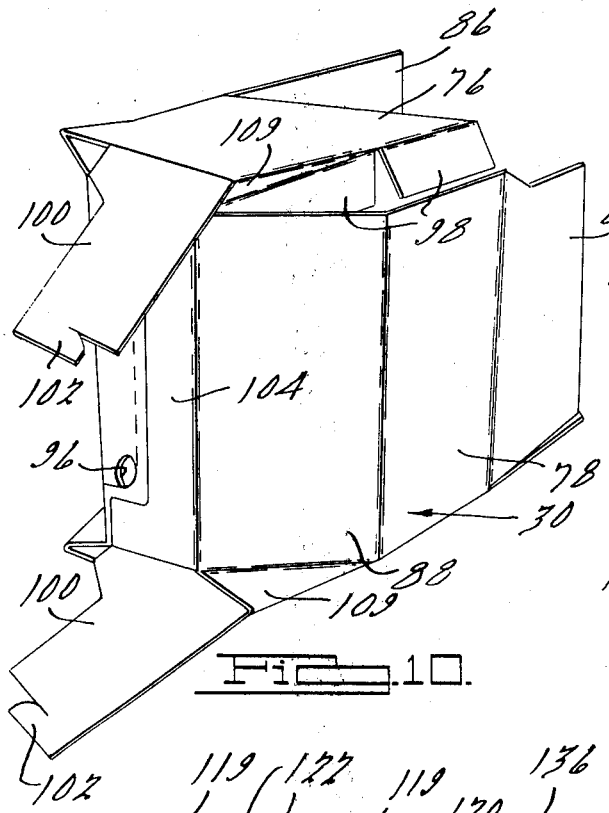
FIG. 10 is a perspective view of a partially assembled inner carton prepared from the die-cut sheet shown in FIG. 9.

The die-cut sheet 74 as shown in FIG. 9 is provided with a pair of flaps 98, which are adapted to be adhesively secured to adjacent panels 78 and 88 during the assembly operation. A pair of ears 100 are integrally formed and project forwardly of the edges of the side panels 76 and are provided with slotted tabs 102 at the ends thereof for interlocking mutual engagement upon assembly as shown in FIG. 5 to form the face panel 82 which overlies flaps 103 and 104. The several panels and flaps are provided with score lines 106 along their mutual edges to facilitate bending or creasing of the sheet during the formation of the carton, as well as score lines 108 along the top and bottom panels defining triangular sections 109 to facilitate formation of the sloped sections. Assembly of the sheet into a preliminarily formed carton is shown in FIGS. 10 and 11 with the latter illustrating the condition at the time the inner carton is ready for filling with a prescribed number, such as 500, dispensable units by automatic high-speed filling techniques.

The inner cartons, after filling, are closed by folding the flaps 103 and 104 inwardly and then folding the ears 100 in overlying relationship and interlocking the tabs 102 forming an inner carton configuration corresponding to that portrayed in FIG. 4 of the drawings. In that condition, the inner cartons are adapted to be loaded within an outer carton in a preselected arrangement such as illustrated in FIG. 4 and wherein the side, face and back panels thereof are slidably disposed in supported relationship against the inner walls of the outer carton and the adjacent inner carton and wherein the bottom and top panels of the inner carton serve to support and stackingly receive overlying inner cartons.

The split-type inner carton 32 may be of an identical construction to the inner carton 30 but preferably, tp provide maximum width of its dispensing apertures, is slightly modified in the region of its face panel. As may be best seen in FIG. 4, a single ear 100′ is employed in lieu of the pair of ears 100 of the carton 30, which extends across the entire face of the carton 32 and is formed with a tab extension 102′ adapted to be interlockingly engaged in a slot 142 provided in the side panel 76′. The entire sloped section 90′ is removable along perforated lines 94′ extending across the top panel 80′ and along the sides adjacent to the triangular sections 109′. A vertical flap 103′ is integrally formed with removable section 92′ and is extracted as a unit, exposing the contents of the inner carton.

A removal of the removable section 92′ is facilitated by the provision of two die-cut apertures 96′, which provide finger grips of the section for gripping and removing the tear-out section along the perforated lines. It will be appreciated that the apertures 96′, as well as the aperture 96 of the cartons 30, can be die-cut in a manner to retain the inner core defining the respective aperture and which core can be quickly and simply removed at the time of intended use by applying moderate finger pressure thereto.

Figure 13:
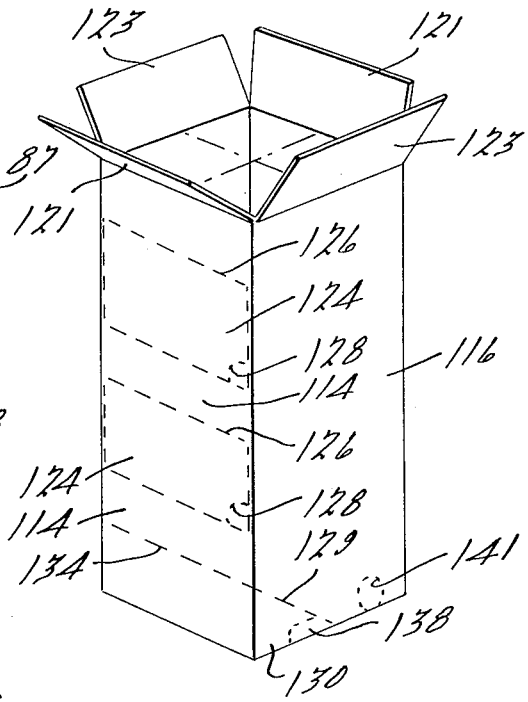
FIG. 13 is a perspective view of an outer carton assembled to a stage in which it is ready to receive a prescribed number and type of inner cartons, and illustrating in phantom the assemblage of the upper flaps for closing the upper end thereof.
Figure 12:
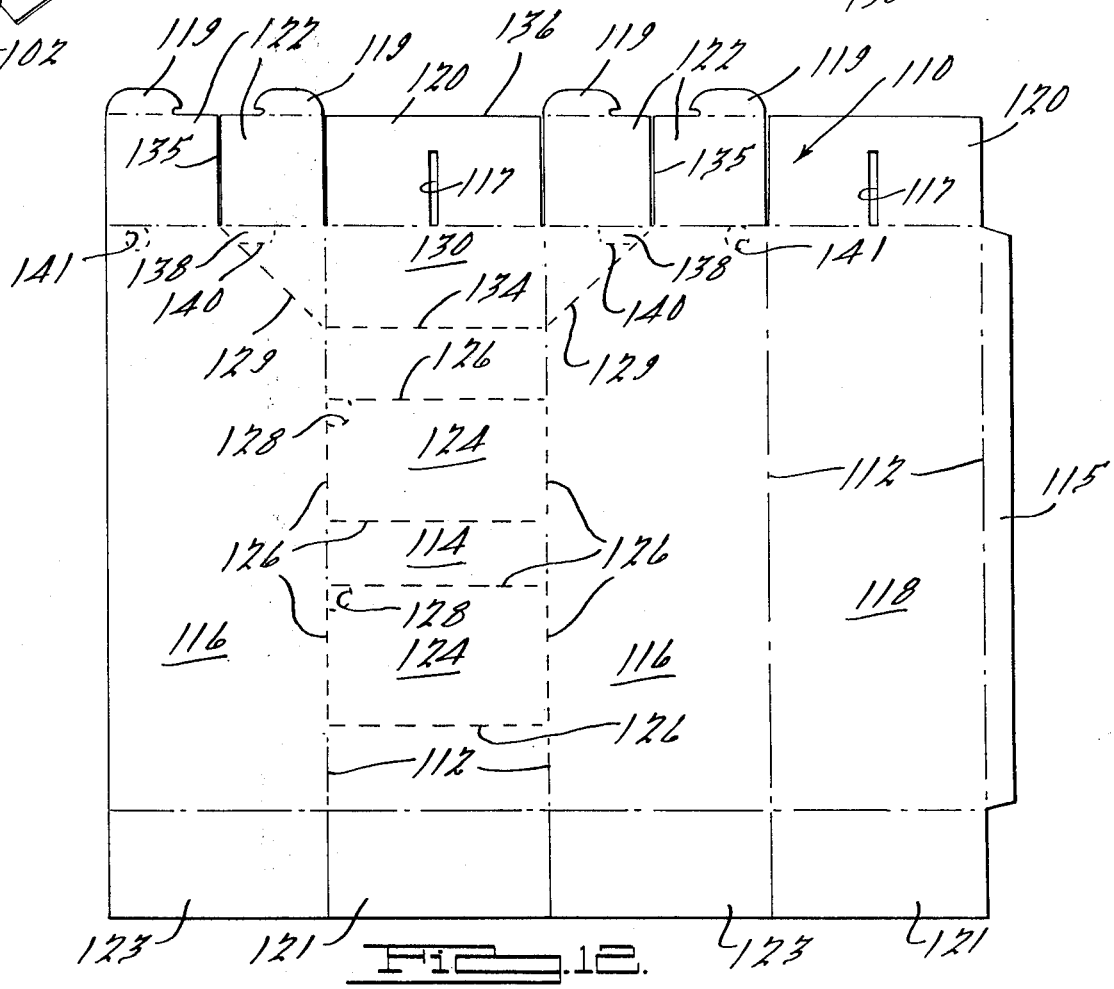
FIG. 12 is a plan view of a die-cut sheet assemblable into an outer carton of the type shown in FIG. 3 of the drawings.

The outer carton, such as the outer carton 28 shown in FIGS. 1, 3 and 13, is formed by folding a die-cut sheet 110, as illustrated in FIG. 12, along score lines 112 to form a three-dimensional enclosure as illustrated (in an inverted position) in FIG. 13 comprising a face wall 114 of a generally planar rectangular configuration, a pair of side walls 116, a rear wall 118, upper and lower end flaps 120, 121 and upper and lower side flaps 122, 123. A flap 115 is provided along one edge of a rear wall 118 for adhesively securing it to the adjacent edge of a side wall 116. The upper end flaps 120 are formed with slots 117 for slidably receiving tabs 119 integrally formed along the outer edges of the upper side flaps 122 for effecting an interlocking fit upon closure of the upper end and side flaps after loading of the outer carton. The size and configuration of the outer carton is controlled so as to slidably and supportedly receive the inner cartons to retain them in appropriate supported relationship during shipment, handling, storage and during the dispensing operation itself.

The outer surface of the face wall 114 is imprinted with suitable indicia, such as shown in FIG. 1, and the face panel itself is provided with a plurality of tear-out sections 124 defined by the area bounded by a perforated or structurally-weakened line 126, which facilitates a removal of the tear-out sections by inserting one's fingers through apertures formed by removing perforated circular pop-out sections 128, enabling a gripping and pulling out of the section. The uppermost tear-out section, indicated at 130, is of a generally truncated triangular configuration and for this purpose, includes perforated lines 129 angularly extending across the upper corners of the side walls, which intersect at one of their ends with a perforated line 134 across the face wall and at their other ends with a slot 135 provided in the side flaps 122. The rear uppermost edge of the tear-out section 130 is defined by the edge 136 of the end flap 120, which is disposed at a position coinciding with about one-half the depth of the outer carton. The lower edge of the dispensing aperture 48 (FIG. 1) resulting from the removal of the upper tear-out section 130 coincides substantially to the lower edge of the dispensing apertures of the inner dispensing cartons. Each of the removable or tear-out sections in the face wall of the outer carton are disposed in registration with the removable sections of the inner cartons such that in operation, a removal of the tear-out sections exposes the removable sections of the inner cartons, enabling a removal thereof and a dispensing of the contents of the disposable items contained therewithin. The upper inner sides of the tear-out section 130 are provided with an elongated section 138 defined by a perforated line 140 enabling the section 138 to be moved inwardly as shown in FIG. 3 in response to finger pressure to facilitate a gripping of and a removal of the tear-out section 130.

The upper rear corner of the side walls of the outer carton are also provided with circular die-cut pop-out sections 141, as shown in FIGS. 1, 3, 12 and 13, to facilitate a gripping and withdrawal of the filled dispensing units from the shipping carton 68, as shown in FIG. 2.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. A dispensing system for dispensing a selected combination of disposable portion control packets or the like comprising an outer carton having a plurality of interconnected walls defining in combination a three-dimensional enclosure and including a top, a pair of side walls and a substantially planar face wall, a plurality of inner cartons disposed in vertically stacked relationship within said outer carton each comprising a plurality of interconnected panels defining in combination a three-dimensional enclosure and including a face panel adapted to be disposed against the inner surface of said face wall, a bottom panel and a top panel; said top panel of said inner carton formed with a downwardly sloped section disposed adjacent to said face panel, said bottom panel of said inner carton including an upwardly sloped section adjacent to said face panel, said inner cartons disposed in mutual supporting relationship to each other and to the inner surfaces of said walls defining said outer carton, each individual inner carton adapted to be filled with a plurality of packets of identical characteristics and equal in number to those contained in the other inner cartons, each inner carton formed with a removable section in the region of said face panel and said downwardly sloped section for providing access to the interior of said carton upon removal thereof; said face wall of said outer carton formed with a plurality of vertically spaced tear-out sections registrable with said removable sections of said inner cartons which upon removal thereof provides access to said removable sections and to the interior of said inner cartons for effecting an extraction and dispensing of the dispensable items contained therein, the uppermost one of said tear-out sections including a section of the forward portion of said top.

2. The dispensing system as defined in claim 1, in which at least a portion of the boundary of said removable section of said inner carton and of said tear-out section of said outer carton are defined by perforations.

3. The dispensing system as defined in claim 1, in which the uppermost of said tear-out sections in said outer carton includes the uppermost portion of said face wall of said outer carton, the forward portion of said top panel and triangular portions of the adjacent side walls of said outer carton, and said face wall of said outer carton further including indicia adjacent to said tear-out sections indicative of the contents of said inner cartons.

* * * * *